US005873411A

United States Patent [19]

Prentiss

[11] Patent Number: 5,873,411

[45] Date of Patent: Feb. 23, 1999

[54] DOUBLE ACTING RECIPROCATING PISTON PUMP

[76] Inventor: John Gilbert Prentiss, P.O. Box 15458, Santa Fe, N. Mex. 87506-5458

[21] Appl. No.: 835,312

[22] Filed: Apr. 7, 1997

[51] Int. Cl.[6] ..... F04B 11/00

[52] U.S. Cl. ..... 166/105; 417/459

[58] Field of Search ..... 417/459, 488, 417/550, 360, 514; 166/105

[56] References Cited

U.S. PATENT DOCUMENTS

| | | | |
|---|---|---|---|
| 1,941,813 | 1/1934 | Nikon et al. | 103/219 |
| 2,074,912 | 3/1937 | Hutto | 166/105 |
| 2,158,393 | 5/1939 | Aulman | 166/105 |
| 2,930,327 | 3/1960 | Unkous | 103/219 |
| 2,946,387 | 7/1960 | Hooker | 166/105 |
| 3,485,181 | 12/1969 | Hahs | 103/219 |
| 3,510,234 | 5/1970 | Wolf | 417/450 |
| 3,966,360 | 6/1976 | Greene | 417/53 |
| 5,058,667 | 10/1991 | Ramsower | 166/68 |
| 5,456,318 | 10/1995 | Priestly | 166/369 |
| 5,492,535 | 2/1996 | Reed et al. | 604/152 |

*Primary Examiner*—William Neuder

[57] ABSTRACT

A linear double acting reciprocating fluid pump is disclosed with novel anchoring means to remotely secure the pump down hole in deep well applications. The multiple piston pump may be cable operated or directly driven. Using the related remote pump lock in deep well applications, the well casing can double as a discharge conduit. The pump comprises a single tubular barrel containing opposing reciprocating pistons, each piston carrying ample fluid ports with binary valves. Mechanical linkages within the pump barrel alternately reverse opposing pistons causing them to converge and diverge, thus providing a substantially steady fluid discharge and a relatively level demand on the prime mover.

3 Claims, 3 Drawing Sheets

DOUBLE ACTING RECIPROCATING PISTON PUMP

FIELD OF INVENTION

Figure 1:
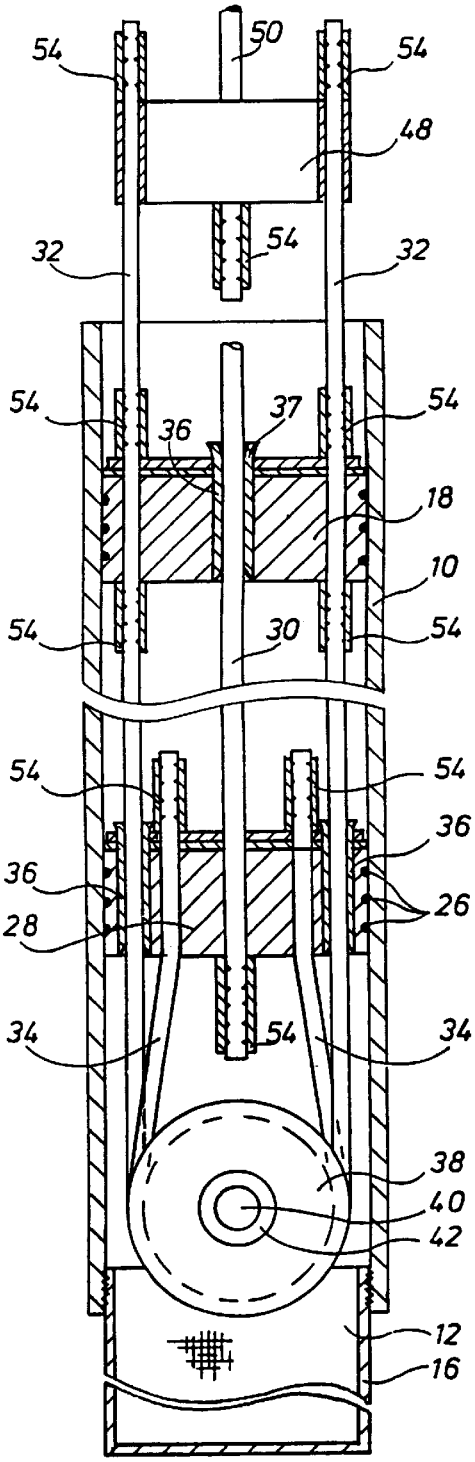

The present invention relates to linear double acting reciprocating piston pumps, specifically to one having alternately diverging and converging pistons disposed in a single tubular barrel with internal piston reversing means, and to a related pump lock secured in a tubular confinement by upward bearing.

BACKGROUND OF INVENTION

Pumping fluids from deep wells presents unique challenges as space limitations are severe and head pressures may be extreme. Oil wells are known to exceed three thousand meters in depth, and water wells exceeding three hundred meters are not extraordinary. Among the most common pumps currently in use in deep well applications are single acting reciprocating piston pumps. These pumps are generally used in conjunction with pump jacks in oil and water wells and are comprised of one or more pistons in a cylindrical pump barrel submerged beneath the static fluid level. A steel discharge conduit, coaxial with the casing and typically at least five centimeters in diameter, is typically be used between the pump barrel and the well head to secure the pump barrel in a fixed position down hole.

The pistons are operated by a rigid rod reciprocating within the discharge conduit and connected to a prime mover at the well head. The ordinary reciprocating rod pump operates on a direct linkage with the piston(s) recharging on the down stroke and discharging on the up stroke causing an imbalanced power demand on the prime mover and often occasioning the need for counterbalancing. The requisite steel discharge pipe anchoring the pump barrel must be of a bore adequate to accept the rod and pistons to allow servicing multiple piston washers without removal of the discharge pipe. At extreme depths, hydraulic friction within the discharge pipe may impede pumping efficiency over what would otherwise be available in the surrounding larger diameter casing, particularly when pumping viscous oil. The capital cost of this type of system, including drilling a large bore hole, then providing large diameter casing a coaxial steel discharge pipe string, pump and drive rod is considerable. When pump barrel or foot valve repairs oblige removal of the discharge pipe from the well, the cost of the operation is considerable.

Submersible electric pumps are another popular means of pumping deep. These include multi-stage rotary turbine, eccentric piston and diaphragm types. These pumps employ rotary electric motors submerged with the related pumping means. They are generally slightly smaller than the inside diameter of a well casing and are installed in a casing by lowering the pump to below the static fluid level. The pump is powered by a high amperage electric supply cable and is installed with an independent discharge conduit as well as a safety cable. While low flow submersible DC electric pumps are now available which are quite energy efficient, they are limited to depths of less than 100 to 200 meters. Furthermore, they typically operate at very low discharge rates. AC electric deep well turbine pumps can lift water from depths of over 300 meters at a rapid discharge rate, but they typically operate at efficiencies well below 80%. In any case, a large diameter well bore must be drilled to eventually receive the down hole pump and motor, and a discharge conduit other than the casino is typically required.

The cost of casing is an important consideration in non-hard rock well construction. Small diameter casing may be safely employed at a greater depth than larger diameter casing having the same wall thickness, as it is more resistant to the lateral pressure from the surrounding strata. Accordingly, savings can be effected where casing size and related bore size can be minimized. Even in hard rock wells, and particularly where free flowing water or oil is known to be present, minimal bore diameter may be determined by the lateral space requirements of the pumping system to be installed.

A novel double acting reciprocating piston pump is disclosed by Ramsower, U.S. Pat. No. 5,058,667. This design appears to include most of the above mentioned drawbacks of single acting piston pumps as it requires a rigid discharge pipe and drive rod to secure and operate the pump within the well. Its double acting operation further requires a submerged down hole weight to return the plunger to the bottom of its stroke while simultaneously counterbalancing and lifting fluid up the discharge pipe to the well head. In deep wells, the size of the counterbalance would be very large of a necessity, and would require that the bore hole accommodate the counterweight protruding far below the pump. Hydraulic friction on the counterbalance would be considerable, especially in viscous fluids.

To overcome the deficiencies of the aforementioned technologies, the inventor sought to design a pump that could be remotely secured within a narrow diameter bore. While down hole anchoring systems are not in wide use today Wolf, U.S. Pat. No. 3,510,234 discloses a single acting cable operated pump utilizing a down hole locking mechanism which enables use of the casing as a discharge conduit. Wolf's design has several drawbacks, the most important being that the bulky locking mechanism significantly impedes potential flow through the juncture between the pump and the well casing. Further, the lock is activated by downward expansion of a resilient collar by a mandrel. This approach to installation obviates the possibility of pulling upward on the pump to expand the collar, as the pump cannot rise in the casing and frictionally communicate with the casing walls at the same time. In addition, it appears that it would be very difficult to free Wolf's collar from the casing walls after having been installed for a long period of time. Pulling upward on the pump would tend to exacerbate a stuck installation, even with the mandrel removed. This and other reasons may account for the fact that Wolf's design apparently has not been widely used.

Nixon and Park, U.S. Pat. No. 1,941,813 disclose a down hole anchor for tubing which is activated by downward fluid pressure on a bellows type collar. This installation is only for use with coaxial discharge tubing within the casing, and requires considerable amount of space to be effectively deployed. Linkous, U.S. Pat. No. 2,930,327 depicts a roller cam device for centering a discharge pipe in the well casing. Both of these systems demand a discharge pipe coaxial with the casing. Neither of these types of lock is used to seal the pump within the casing so that the casing may be employed as the discharge conduit. Hahs, U.S. Pat. No. 3,485,181 cites a support for a subterranean pump installation with an independent but related sealing means to use the casing as a discharge conduit. However, Hahs's lock and seal are designed to be used in conjunction with a rotary turbine pump and they are unnecessarily complex for many pump installations.

In view of the foregoing, existing pumping means available for confined tubular applications have a number of significant limitations. These include the requirement of large bore diameters relative to pump output capacity, low operating efficiencies at high discharge rates, the need in some applications for cumbersome and costly support and counterbalancing structures, and highly uneven power demand on the prime mover in single acting reciprocating pumps. In well applications, costly wide-bore casing) must be provided to receive down hole pumping means, the bore diameter often being considerably in excess of what would be required if smaller diameter, high production pumps were available. Much existing pump technology is capital intensive and in oil wells particularly, pumps in common use are costly to service and repair due to the weight of the drive rod and pipe string which must be removed to remove the barrel.

OBJECTS AND ADVANTAGES OF THE INVENTION

A first object of the present pump is to provide an efficient linear fluid pump of relatively unlimited stroke that may be remotely deployed in a narrow linear confinement without an independent discharge pipe string. A second object is to provide a narrow linear pump that has a substantially level power requirement and continuous, high output, high efficiency discharge. A third object is to provide an improved remote pump lock engaged by upward bearing. A forth object is to minimize the costs of well drilling, casing, pump installation and maintenance. A fifth object is to provide a pump and remote lock that enable the use of a well casing as a discharge conduit. A sixth object is to enable the optional use of flexible linkage in a double reciprocating pump. A seventh object is to optionally provide a double acting reciprocating pump which may be driven by a single rod linkage. An eighth object is to provide a pump and pump lock wherein hydrostatic friction through the system is minimized to improve operating efficiency and discharge rate. These and other objects and advantages will become further apparent in the following drawings and descriptions.

DRAWING FIGURES

FIG. 1 discloses a cable operated embodiment of the subject pump in section

Figure 2:
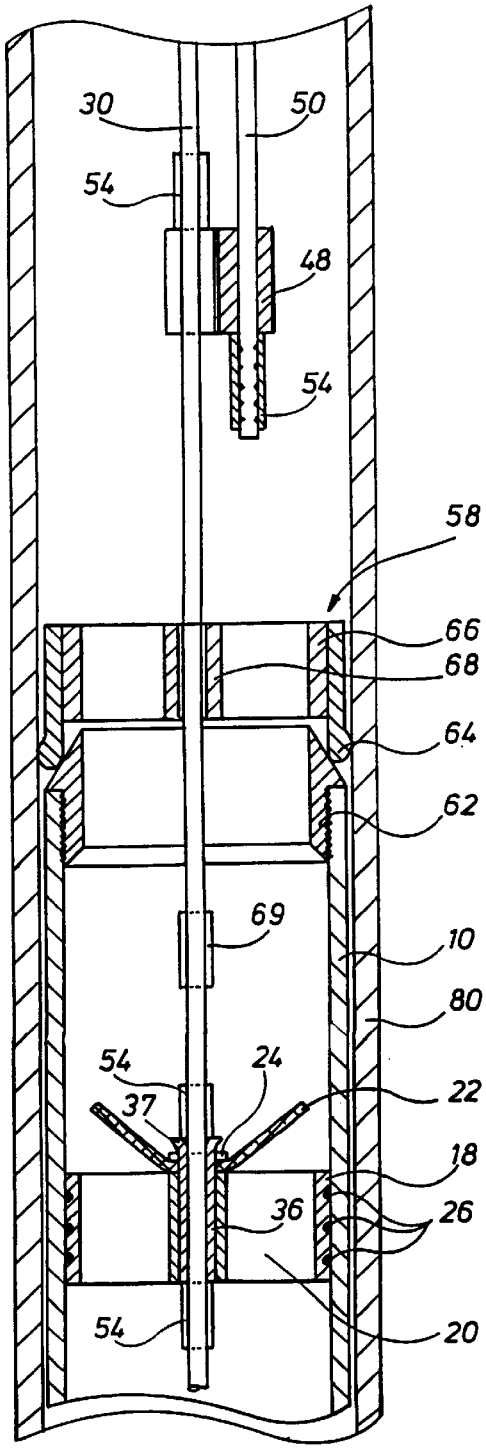

FIG. 2 disclosing the optional remote pump lock engaged in an outer casing

Figure 3:
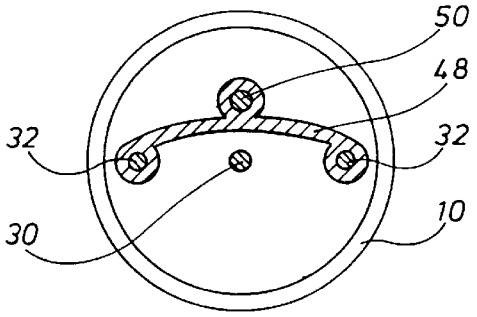
Figure 5:
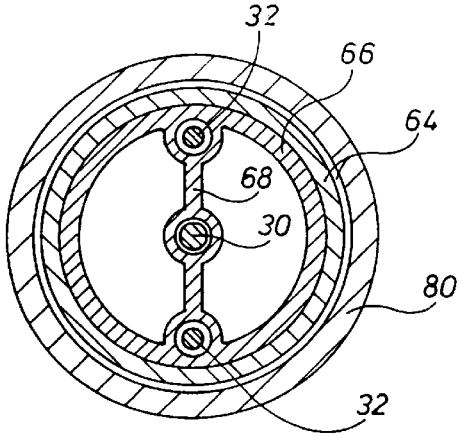
Figure 4:
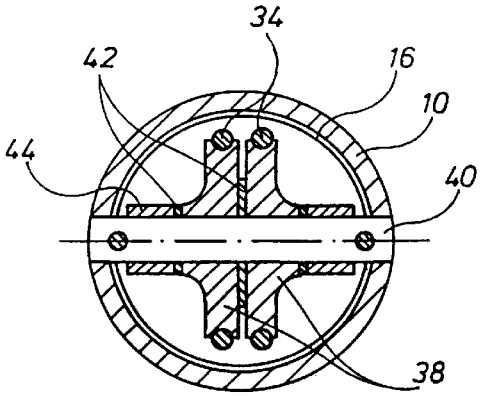
Figure 8:
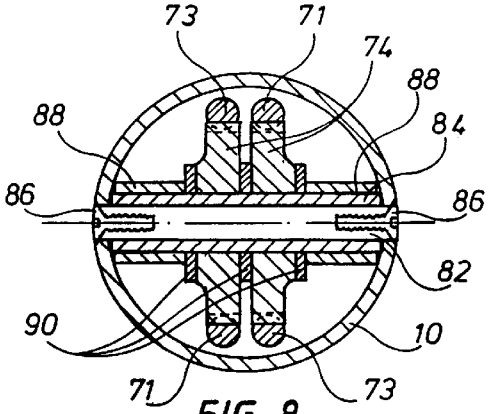
Figure 6:
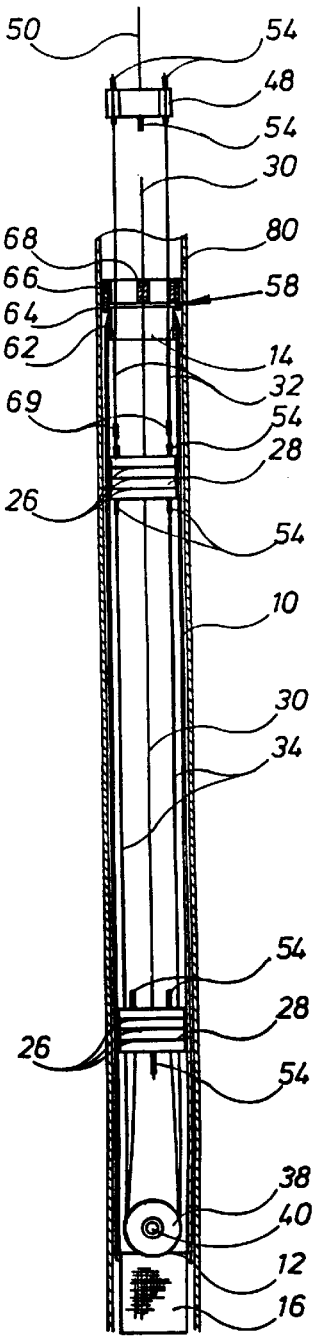
Figure 7:
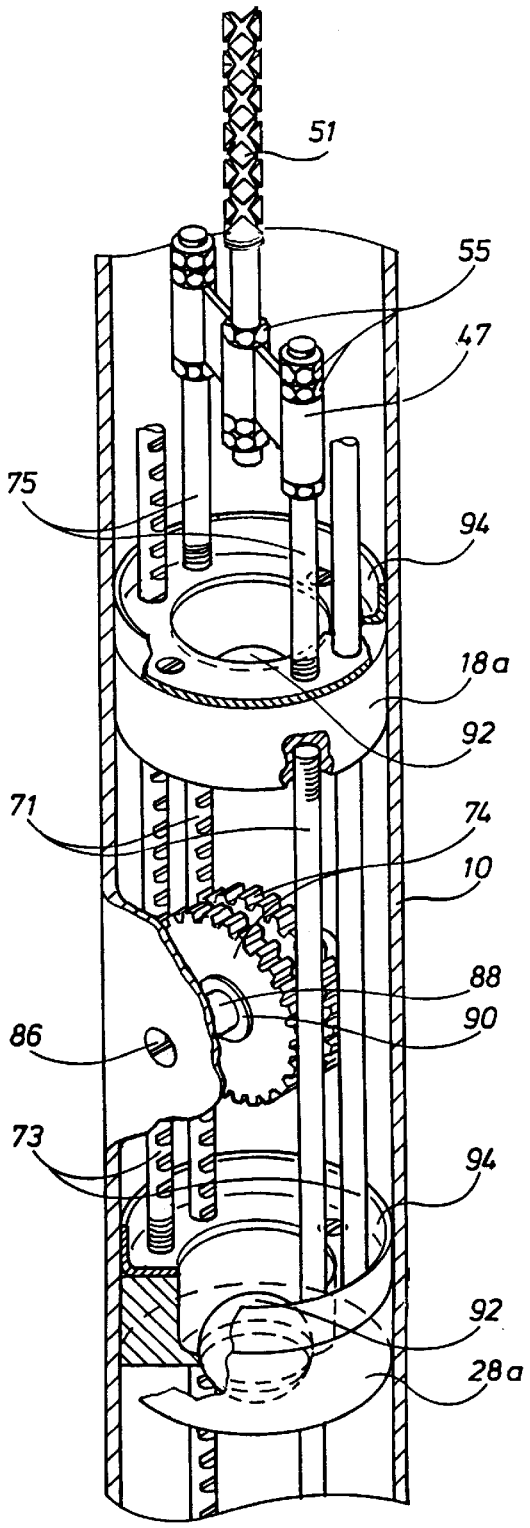

FIG. 3 is a section through the cable yoke of FIG. 2, rotated 90 degrees FIG. 4 is a section through the cable pivot assembly of FIG. 1, rotated 90 degrees FIG. 5 is a section through the locking collar of FIG. 2, rotated 90 degrees FIG. 6 is a partial section of a cable operated pump installed with a remote lock assembly FIG. 7 is a cut away perspective of a rack and pinion embodiment employing ball valves FIG. 8 is a section through the pinion sear assembly of FIG. 7

SUMMARY

In accordance with the present invention, a linear double reciprocating pump comprises a singular tubular barrel in which opposing pistons carrying dynamically valved ports are reversibly linked within the pump barrel. A pump lock fitted to the discharge end of a pump engages the inner walls of the coaxial confinement by sustained upward bearing to remotely secure and the pump.

DESCRIPTION—FIGS. 1 to 8

FIGS. 1 discloses a pump barrel 10 which is a wear resistant rigid cylindrical tube open at both ends. Removeably affixed to the intake end 12 is a filter screen 16. Barrel diameter may range from less than 5 centimeters up to a meter or more, depending on the application. The length of barrel 10 generally should be approximately three times the stroke of the pump. Stroke length may be from less than a few centimeters to many meters, depending on the drive apparatus and application. For installations using remote locking means described herein, the available stroke should exceed the working stroke by an amount sufficient to effect remote locking and unlocking procedures, outlined below.

The piston detail shown in FIG. 2, discloses fluid ports 20 equipped with related flap valves 22, held in place by valve retainer 24 which is in turn partially secured by a flange 37 on the upper end of piston bushing 36. Piston bushings 36 are press fit into the pistons and provide a means for piston drive cables to slideably pass through the pistons without significant blow-by or cable abrasion. Flap valves 22, shown schematically, hinge at valve retainer 24 to open and close ports 20 by hydrodynamic action depending on the movement of the related piston. Piston seals 26 prevent excessive blow-by at the piston-barrel interface. Upper piston 18 carries similar ports 20 with related flap valves 22, valve retainers 24, piston seals 26, and bushings 36. Both upper piston 18 and lower piston 28 are slideably disposed in barrel 10. In many applications, cables may be employed cost effectively as the piston linkage and reversing means. Aramid fiber (Kevlar) rope with nylon shielding is suggested, manufactured by Cortland Cable Co., Cortland, N.Y. Upper piston drive cables 32 in this embodiment pass through upper piston 18 to then serve as reversing cables 34 which reverse direction on sheaves 38. Reversing cables 34 are secured to lower piston 18 by cable fasteners 54 (shown schematically) which are also used to secure the upper piston drive cables 32 and piston reversing cables 34 to upper piston 18. Piston reversing cables 34 slideably pass through lower piston 28 at piston bushings 36. Piston bushings 36 allow optimal clearance to avoid undue passage of fluid at these connections while not impeding the system with excessive friction. Where pistons are made of carbon impregnated nylon, or other polymeric self-lubricating material, piston bushings 36 may be eliminated. A single lower piston drive cable 30 is secured to lower piston 28 with cable fastener 54, thereafter slideably passing through bushing 36 in upper piston 18 and thence to the prime mover. Cable reversing sheaves 38, detailed in FIG. 4, are pivotally disposed on pivot 40 which bridges the diameter of pump barrel 10 and is secured at each end against lateral movement by cotter pins 46. Spaces 44 and thrust washers 42 retain sheaves 38 in position. Where a polymeric pump barrel is employed, a reinforcing pivot support bracket may be required. Upper piston drive cables 32 are secured by means of cable fasteners 54 at cable yoke 48, detailed in FIG. 3. A cable fastener 54 secures yoke drive cable 50 to cable yoke 48. Drive cables 30 and 50 may be color coded or otherwise marked at the well head in deep well applications to assist in the installation of the remote locking means as more fully described below.

In operation, intake end 12 and screen 16 are submerged in the fluid to be pumped. Pump barrel 10 is secured against movement relative to the prime mover. The prime mover alternately reciprocates lower piston drive cable 30 and yoke drive cable 50 in equal strokes commensurate with the working stoke of the pump. As drive linkage 50 is pulled upward, piston 18 is pulled upward via cable yoke 48 and related upper piston drive cables 32. Hydrodynamic action causes flap valves 22 in upper piston 18 to close, thereby discharging fluid out discharge end 14. Reversing cables 34 simultaneously pull lower piston 28 downward via reversing cable sheaves 38, thereby causing flap valves 22 on lower piston 28 to open. Fluid is drawn by suction into the widening gap between opposing pistons 28 and 18 through ports 20 in lower piston 28, and through the related flap valves 22 which are hydrodynamically opened. At the completion of the stroke, tension on drive cable 50 is relaxed as drive cable 30 pulls upward on lower piston 28. Reversing cables 34 pull upper piston 18 downward, and the pistons converge. As the pistons converge, flap valves 22 on lower piston 28 hydrodynamically close while flap valves 22 on upper piston 18 are forced open by the fluid displaced by lower piston 28. On lower piston 28 up stroke, fluid displaced by lower piston 28 passes through ports 20 in upper piston 18 and thereafter is discharged at discharge port 14. Repetition of the foregoing cycles produces an even discharge and a level demand on the prime mover.

FIG. 2. further discloses a remote pump lock. Pump barrel 10 is secured in casing 80 by means of lock assembly 58, further detailed in FIG. 5. FIG. 6 shows the lock installed with the subject pump. Lock assembly 58 is comprised of support member 66 with a central release bridge 68 spanning the inner diameter of the support member through which cables 30 and 32 freely pass. A resilient collar 64 is bonded to support member 66 and is sized to slideably fit within the casing 80. Pump barrel 10 is fitted with a tapered extension 62 which expandably engages resilient collar 64.

To remotely install the pump in casing 80, the pump and lock assembly 58 are lowered to the proper working depth with the pistons positioned approximately in mid-stroke. Once in position, the lower piston drive cable 30 is pulled upward against the weight of the pump to its fullest extent causing cable yoke 48 to engage and pull down against release bridge 68. This action forces engagement of the tapered barrel extension 62 into resilient collar 64, expanding the collar 64 against the inner walls of the casing 80 to provide a seal between the pump barrel 10 and the casing 80. Continual bearing is thereafter maintained via the drive cables to sustain pump lock engagement.

To unlock and remove the pump, drive cable 50 is pulled to its uppermost extremity causing release lugs 56 strategically affixed to the upper piston drive cables 32 to engage release bridge 68 from below. Release of upward tension on the lower piston drive cable 30 enables the considerable weight of fluid held above the pump to force the body of the pump downward, breaking the seal between the tapered barrel extension 62 and resilient collar 64. Additional hydraulic or pneumatic pressure may be applied from the well head in the unlikely event fluid weight is insufficient to free the seal. Once the seal is broken, fluid above the pump drains through the free space between pump barrel 10 and casing 80 and the pump thereafter may be lifted from the well with the lock fully disengaged.

Upward force on drive cable 50 lifts the pump from the well while keeping pump lock assembly 58 disengaged by means of release lug 56. As noted above, drive cables should be coded at the wellhead to effect proper locking and unlocking operations. During normal operation of the pump, sufficient upward tension must be maintained on both drive cables 30 and 50 to keep pump lock assembly 58 engaged and sealed within casing 80. The stroke at the well head is thereafter limited sufficiently that pistons will not exceed their normal operating strokes to inadvertently engage or disengage the pump lock.

FIG. 7 depicts a rack and pinion embodiment driven by a single drive rod 51. Drive rod 51 is affixed with threaded nuts 55 to yoke 47. Yoke 47 is linked to upper piston 18*a* by upper piston drive rods 75 which are securely threaded into upper piston 18*a*. Extending downward directly below drive rods 75 from the underside of upper piston 18*a* are the upper piston rack gears 71 which are also securely threaded into upper piston 18*a*. Upper piston rack gears 71 each engage separate pinion gears 74 and continue to extend slideably through passageways (not shown) in lower piston 28*a* in a manner similar to the cables in the foregoing embodiment. A second set of rack gears are securely threaded to lower piston 28*a*. Lower piston rack gears 73 extend upward to each engage pinion gears 74. Thereafter, lower piston rack gears 73 slideably pass through passageways in upper piston 18*a*. Pinion gears 74 are pivotally suspended between the walls of pump barrel 10 on pinion pivot 82, detailed in FIG. 8. To install pinion pivot 82 in a one piece barrel, the entire inner assembly of the pump is inserted into pump barrel 10 as a unit and pivot tube 84 aligned with diametrically opposed holes in pump barrel 10. Pinion pivot 82 is then inserted in pivot tube 84 and secured at each end with bolts 86. Pinion pivot tube 84 carries spacers 88 and thrust washers 90 for proper alignment of pinion gears 74. Upper and lower pistons 28*a* and 18*a* each carry ball valves 92 and leather piston washers 94. Piston washers 94 are secured to the tops of the pistons.

In operation, as drive rod 51 is drawn upward, yoke 47 and related upper piston drive rods 75 pull upper piston 18*a* upward in pump barrel 10. As in the above cable operated embodiment, valve and piston action is identical. Pistons are reversibly connected through the rack and pinion gears, with opposing rack gears or extensions thereof passing slideably through the opposing pistons. The pivotal piston reversing means is centrally located to save space and improve efficiency of operation in this embodiment.

RAMIFICATIONS AND SCOPE

"Up" and "down" orientations are used for simplification and should not be construed to limit the scope of the pump and remote lock to vertical applications. The invention can operate effectively when otherwise oriented by biasing the valves. Piston reversing linkages may comprise gears, chains and sprockets or other commonly known mechanical direction reversing means. Elongate piston linkages may comprise slick rods where these linkages pass through pistons, reducing blow-by and wear, but necessitating a corresponding elongation of the pump barrel or shortening of the piston stroke. It appears obvious that rack gears in the FIG. 7 embodiment may be terminated before penetrating opposing pistons, thereby eliminating the passageways shown but remaining within the spirit of the invention. This modification likewise necessitates elongation of the pump barrel or shortening of the stroke, but may constitute a desirable feature in some applications. Changes in valves and valve types, linkages, guides and linkage connecting means for various applications will be apparent to those skilled in the art.

The appended drawings depict the basic nature of the invention in demonstrative form and should not be construed to limit the invention beyond that which is comprehensively circumscribed by the appended claims that follow.

I claim:

1. A linear double acting reciprocating fluid pump comprising:

a. a single straight rigid tubular barrel uniform in cross section along the majority of the length of said barrel, said barrel having an intake opening at the first end, the intake end, and a discharge opening at the second end, the discharge end;

b. at least two pistons having outer diameters sized to slideably and sealably fit within the inner diameter of said barrel, said pistons disposed within said barrel to linearly converge and diverge from within separate portions of the length of said barrel;

c. at least one fluid port through each of said pistons approximately parallel to the linear paths of said pistons to allow passage of fluid through each of said pistons;

d. binary fluid dynamic valve means controlling fluid flow through each of said fluid ports, said valve means aligned so as to fluid dynamically open upon movement of each of said pistons toward said intake end of said barrel and to fluid dynamically, sealably close upon movement of said pistons toward said discharge end of said barrel;

e. elongate mechanical piston linkage means disposed within said barrel, said piston linkage means communicating between said pistons to alternately converge and diverge said pistons within said barrel when driven by a prime mover;

f. mechanical transmission and reversing means pivotally disposed within said barrel and communicating with said piston linkage means to effect direction reversing of said piston linkage means;

g. linear mechanical drive linkage means communicating between said prime mover and at least one of said pistons, said drive linkage means reciprocating said pistons in substantially equal and opposite strokes, and;

h. mechanical means to secure said barrel against the force of said prime mover.

2. The linear double acting reciprocating fluid pump of claim 1 wherein said means to secure said barrel against the force of said prime mover comprises locking means to remotely secure said pump in a coaxial tubular confinement such as a well casing, said confinement having an inside diameter greater than the outer diameter of said pump, said locking means further comprising;

a. an expandable collar sized to slidably fit within said tubular confinement;

b. a rigid engagement member inwardly tapered at said discharge end of said pump;

c. means to forcibly introduce said engagement member into said collar, said engagement member thereby expanding said collar to firmly communicate with the inner walls of said tubular confinement;

d. means to maintain persistent upward bearing on said engagement member to sustain communication between said collar and said inner walls of said tubular confinement; and e. means to remotely disengage said engagement member from said collar.

3. Remote pump locking means for a submersible pump to facilitate the use of a well casing as a discharge conduit, said locking means comprising:

a. an expandable collar sized to slidably fit within said tubular confinement;

b. an inwardly tapered engagement member affixed to the upper end of said submersible pump;

c. means to forcibly introduce said engagement member into said collar, said engagement member thereby expanding said collar to firmly communicate with the inner walls of said tubular confinement;

d. means to maintain persistent upward bearing on said engagement member to sustain communication between said collar and said inner walls of said tubular confinement to provide a continuous annular seal between said pump and said tubular confinement; and e. means to remotely disengage said engagement member from said collar.

* * * * *